United States Patent [19]

Chan et al.

[11] Patent Number: 4,915,605

[45] Date of Patent: Apr. 10, 1990

[54] METHOD OF CONSOLIDATION OF POWDER ALUMINUM AND ALUMINUM ALLOYS

[75] Inventors: Hing Chan, Dixon; Brian L. Oslin, Carmichael; Raymond L. Anderson, Redding, all of Calif.

[73] Assignee: Ceracon, Inc., Sacramento, Calif.

[21] Appl. No.: 350,457

[22] Filed: May 11, 1989

[51] Int. Cl.[4] ..... B22F 3/00

[52] U.S. Cl. ..... 419/6; 419/49; 75/249

[58] Field of Search ..... 419/49, 6; 75/249

[56] References Cited

U.S. PATENT DOCUMENTS

| | | | |
|---|---|---|---|
| 3,356,496 | 12/1967 | Hailey | 75/226 |
| 3,556,780 | 1/1971 | Holtz, Jr. | 75/203 |
| 3,561,934 | 2/1971 | Steven | 29/182.7 |
| 3,689,259 | 9/1972 | Hailey | 75/226 |
| 3,700,435 | 10/1972 | Chandhok | 75/214 |
| 3,706,579 | 12/1972 | Michael | 106/1 |
| 3,723,109 | 3/1973 | Lacock et al. | 75/214 |
| 3,746,518 | 7/1973 | Holtz, Jr. | 29/182.7 |
| 3,826,807 | 7/1974 | Green | 264/39 |
| 3,886,254 | 5/1975 | Tanaka | 264/332 |
| 3,992,200 | 11/1976 | Chandhok | 75/211 |
| 4,227,927 | 10/1980 | Black | 75/225 |
| 4,265,681 | 5/1981 | Krause et al. | 148/111 |
| 4,389,362 | 6/1983 | Larsson | 264/111 |
| 4,428,906 | 1/1984 | Rozmus | 419/48 |
| 4,446,100 | 5/1984 | Adlerborn et al. | 419/26 |
| 4,499,048 | 2/1985 | Hanejko | 419/6 |
| 4,499,049 | 2/1985 | Hanejko | 419/6 |
| 4,501,718 | 2/1985 | Bradt | 419/49 |
| 4,518,441 | 5/1985 | Hailey | 148/11.5 P |
| 4,539,175 | 9/1985 | Lichti et al. | 419/49 |
| 4,541,877 | 9/1985 | Stadelmaier et al. | 148/101 |
| 4,554,130 | 11/1985 | Ecer | 419/8 |
| 4,568,516 | 2/1986 | Adlerborn et al. | 419/48 |
| 4,597,456 | 7/1986 | Ecer | 175/371 |
| 4,602,957 | 7/1986 | Pollock et al. | 75/246 |
| 4,603,062 | 7/1986 | Ecer | 427/181 |
| 4,630,692 | 12/1986 | Ecer | 175/330 |
| 4,640,711 | 3/1987 | Lichti et al. | 75/248 |
| 4,656,002 | 4/1987 | Lizenby et al. | 419/10 |
| 4,667,497 | 5/1987 | Oslin et al. | 72/62 |
| 4,715,313 | 12/1987 | Ecer | 118/105 |
| 4,744,943 | 5/1988 | Timm | 419/10 |

*Primary Examiner*—Brooks H. Hunt
*Assistant Examiner*—Ngoclan Mai
*Attorney, Agent, or Firm*—William W. Haefliger

[57] ABSTRACT

A method of consolidating metal powders selected from the group consisting essentially of aluminum, aluminum alloys, and aluminum metal matrix composites includes: pressing the powder into a preform, and preheating the preform to elevated temperatures; providing a bed of flowable pressure transmitting particles; positioning the preform in such relation to the bed that the particles encompass the preform; and pressurizing the bed to compress the particles and cause pressure transmission via the particles to the preform, thereby to consolidate the body into desired shape. Typically, the metal powder has surface oxide, and such pressurizing is carried out to break up, partially or fully, the surface oxide.

12 Claims, 3 Drawing Sheets

METHOD OF CONSOLIDATION OF POWDER ALUMINUM AND ALUMINUM ALLOYS

BACKGROUND OF THE INVENTION

This invention relates to articles formed by pressure forming or shaping, and more specifically, to an improved method which enables complex bodies to be made from aluminum, aluminum alloys, and various aluminum matrix composites to near net shape, by utilization of a non-gaseous medium which transmits pressure applied by a simple press to the material being shaped.

More particularly, the invention relates to the production of powder metallurgy (P/M) aluminum alloy products, and more particularly to improvement of materials properties without extensive deformation and post treatment of the consolidated material. In certain aluminum alloys, the materials properties of the consolidated P/M alloy are far superior than ones produced by conventional methods.

Aluminum alloy products can be produced by either the conventional wrought or powder metallurgy (P/M) methods. In wrought or ingot metallurgy, the metal is allowed to melt completely and solidify inside an ingot. In powder metallurgy, the melted aluminum alloy is solidified into small particles by a cooling gas or rotating surface. The as-atomized powder oxidizes immediately and forms a flexible and continuous oxide layer surrounding the individual particles. It is this surface layer which prevents good diffusion bonding between adjacent particles during conventional consolidation methods.

The consolidation of P/M aluminum has long been a challenge because of persistent problems caused by particle surface oxides. Even in very low oxygen partial pressures, aluminum readily forms this surface oxide layer. Unlike other metals, such as copper, this oxide layer cannot be reduced by cracking hydrocarbon or ammonia treatment. The existing technology to shear the oxide layer on aluminum particles is typically based on extrusion of vacuum hot pressed or sintered billets. The tensile properties of extruded materials are quite good, but the material develops a grain directionality, which may not be favorable in the target application.

Hot pressing and sintering are the two general methods to consolidate powder aluminum alloys. After hot pressing, the material properties, especially the tensile properties, of P/M aluminum alloys are generally very low and unacceptable for any structural applications. However, when this hot pressed material is extruded, the material properties become acceptable due to the dispersing effect of the extrusion on the particle surface oxides. The extensive deformation required during commercial extrusion shears the surface oxides and disperses them among the prior particle boundaries of the consolidated alloy. Therefore, the material develops a more homogeneous microstructure with much-improved material properties. The extrusion process has been regarded as an essential step in the production of P/M aluminum alloy products. However, comparing the extruded material properties with those of the more conventional wrought material, the strength is improved, but the ductility is lowered.

SUMMARY OF THE INVENTION

A major object of the invention is to provide P/M articles via a consolidation method that eliminates the need for extensive deformation as introduced by an extrusion step. This invention satisfies the surface oxide breakup requirement and achieves excellent particle bonding, leading to improved materials properties. In addition, these properties can be controlled by the different consolidation parameters other than the conventional heat treatment after consolidation.

Basic steps of the method include:

(a) Providing a pressed-powder preform selected from aluminum, aluminum alloys, or aluminum metal matrix composite, (b) preheating the preform to an elevated temperature, (c) providing a Pressure Transmitting Medium (PTM) and positioning the heated preform to contact the bed, (d) and consolidating the preform to near 100% density by application of pressure to the PTM bed.

It is a further object of the invention to control the preheating of the preform to prevent incipient melting or coarse dispersion formation. The overall desirable material properties decrease if either of these phase formations prevail during the preheating. Further, the PTM typically consists of carbonaceous particles at an elevated temperature. At elevated temperatures, these particles protect the aluminum particles from further oxidation during the consolidation process. As a result, the original particle surface oxide is broken without the continuous formation of new oxides during consolidation.

Advantages of the method include: Elimination of workhardening of some materials; reduction of overall manufacturing costs by allowing production of more complex parts; improved manufacturing by forming at ideal temperatures; simplified material handling and storage by allowing one step production; improved control of dimensions; reduced forming stresses; increased die life due to indirect contact between die and part; increased part size formation; lowered time at temperature for parts; reduction of costs by elimination of complex punches.

Further, by use of graphitic grain as the pressure transmitting media, pseudo-isostatic pressure transmission to all surfaces in the pressure chamber cause forming in all directions. This will form the workpiece to the desired shape with great accuracy, and eliminate the need for costly, complex punches. With the use of graphitic PTM that can be heated to high temperatures, the workpiece can maintain its desired forming temperature throughout the forming process. This can reduce stresses, work-hardening, and other detrimental effects of forming.

These and other objects and advantages of the invention, as well as the details of an illustrative embodiment, will be more fully understood from the following specification and drawings, in which:

DRAWING DESCRIPTION

DETAILED DESCRIPTION

The basic method of producing the consolidated articles selected from the group consisting essentially of aluminum, aluminum alloys, or aluminum metal matrix composites includes the steps:

(a) pressing the powder into a preform, and preheating the preform to elevated temperatures, (b) providing a bed of flowable pressure transmitting particles, (c) positioning the preform in such relation to the PTM bed that the particles totally encompass preform, (d) and pressurizing the bed to compress said particles and cause pressure transmission via the particles to the preform, thereby to consolidate the body into desired shape.

Typically, the metal powder has surface oxide, and the pressurizing step is carried out to break up the surface oxide during consolidation of the preform. Examples of such powder include 2124 aluminum and 6061 aluminum alloy.

Figure 1:
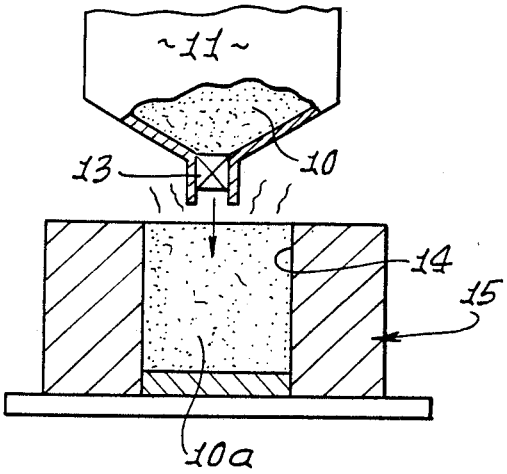
FIGS. 1–4 are elevations, taken in section, showing processing of an aluminum, aluminum alloys, or aluminum metal matrix composite preform.
Figure 2:
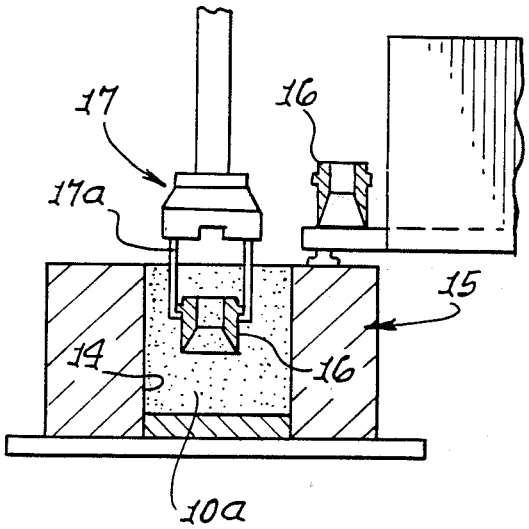

Referring to FIGS. 1–4, carbonaceous PTM 10 (such as graphite) is preheated in a heater 11, to between 664K (700° F.) and 1033K (1400° F.), and then passed via valve 13, by gravity, into a cavity 14 formed by die 15. PTM filling the cavity appears at 10*a*. That PTM is disclosed and described in detail in U.S. Pat. No. 4,667,497, incorporated herein, by reference. In FIG. 2, a preheated metallic preform 16 (594-933K) is transferred by robot 17 and hangers 17*a* into the heated PTM, the robot downwardly thrusting the preform into the PTM bed 10*a* so that the preform is embedded in and surrounded on all sides by the PTM. The preform is initially formed by cold pressing between 10 TSI and 60 TSI, in a hard die or other method, aluminum alloy powder of varying or uniform powder mesh size such as are shown in Table I. The preform 16 is then pre-heated at about 903K (1166° F.) after which the preform is plunged into the PTM, as described. PTM pre-heating is to temperature between 644K (700° F.) and 1033K (1400° F.).

TABLE I

| Starting Powder Particle Distribution | |
|---|---|
| Size | Volume Percent |
| >150 | Trace |
| >75 | 11.4 |
| >45 | 40.8 |
| <45 | 47.8 |

Figure 3:
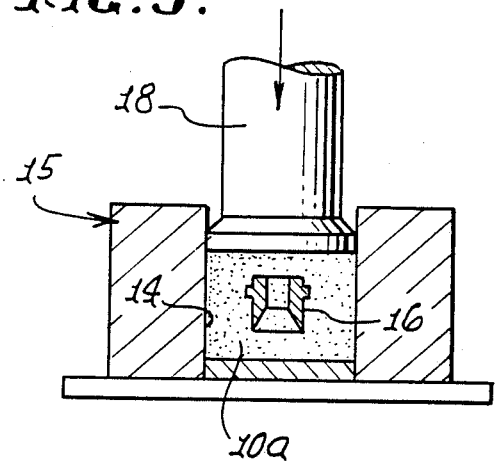

FIG. 3 shows a ram 18 pressurizing uniaxially downward the PTM grain in the die, to effect consolidation of the preform, and to break up oxides on the powder particle surfaces, by deformation, during consolidation. Sufficient pressure (about 1.24 GPa) is exerted for about one second to achieve full density. Pressure within the range 0.68 and 1.30 GPa is acceptable.

Figure 4:
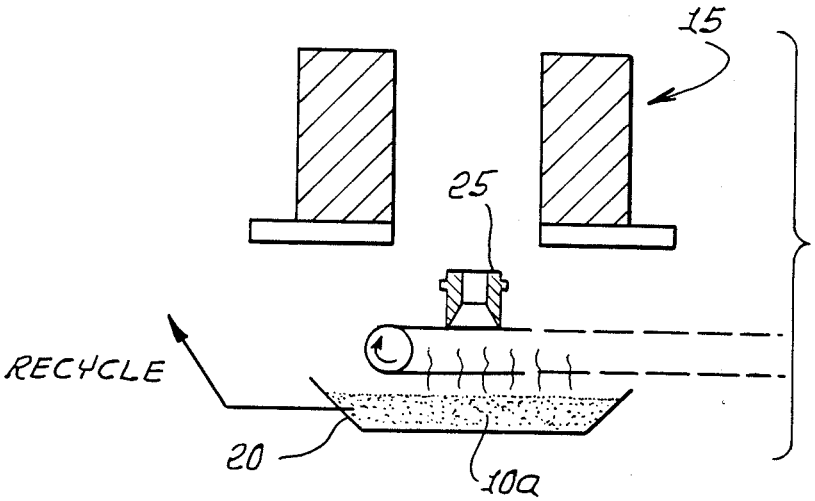

In FIG. 4, after consolidation the ram is removed, the bottom die plate is lowered, and the consolidated preform, i.e., the product 25 is retrieved. At this same time, the PTM 10 falls way for collection at 10*a* in a collector 20 for recycling to the heater.

After solution treatment, tensile specimens were machined and heat treated to the T6 condition. Uniaxial tensile tests were performed on the consolidated Al alloy specimen as well as upon a wrought 6061-T651 specimen for mechanical property comparison. The tensile tests were conducted on a MTS servohydraulic load frame at a constant engineering strain rate of $2\times10^{-4}s^{-1}$.

Figure 5:
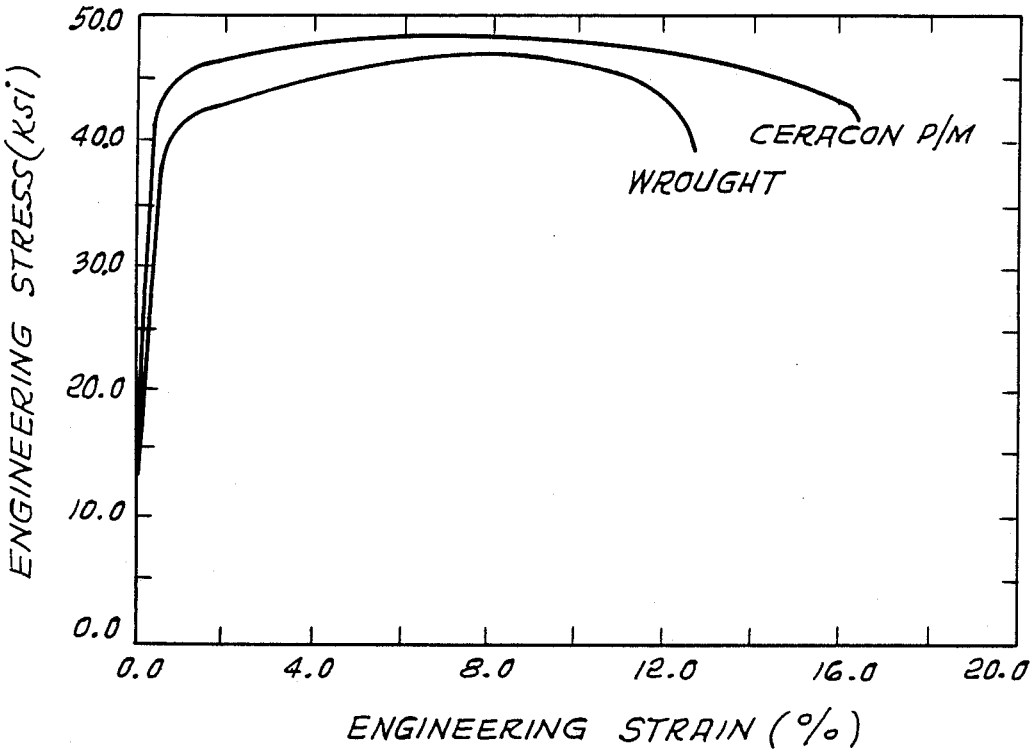
FIG. 5 is a stress-strain diagram for 6061-T6 aluminum alloy samples, one being wrought and the other being a consolidated powder article in accordance with the present invention.

The rapidly consolidated and thus processed P/M 6061 aluminum alloy exhibited a definite improvement in both strength and ductility compared to the wrought material. Typical tensile data for the two materials are illustrated in FIG. 5. Depending on the processing conditions, the yield strength of the consolidated 6061 ranges from 278 to 301 MPa (40.3 to 43.7 ksi), with an average of 292 MPa (42.4 ksi). The average ultimate tensile strength is 331 MPa (48.0 ksi), with a range of 306 to 349 MPa (44.4 to 50.6 ksi). These results can be compared to a yield strength of 278 MPa (40.3 ksi) and a tensile strength of 322 MPa (46.8 ksi) for the wrought material. The ductility of the consolidated material averaged 15.6%, substantially greater than the 12.3% ductility of the wrought material. After solution heat treatment, the consolidated material extrudes further with a pressure of 10 to 15% less than that used for the wrought material.

Figure 6:
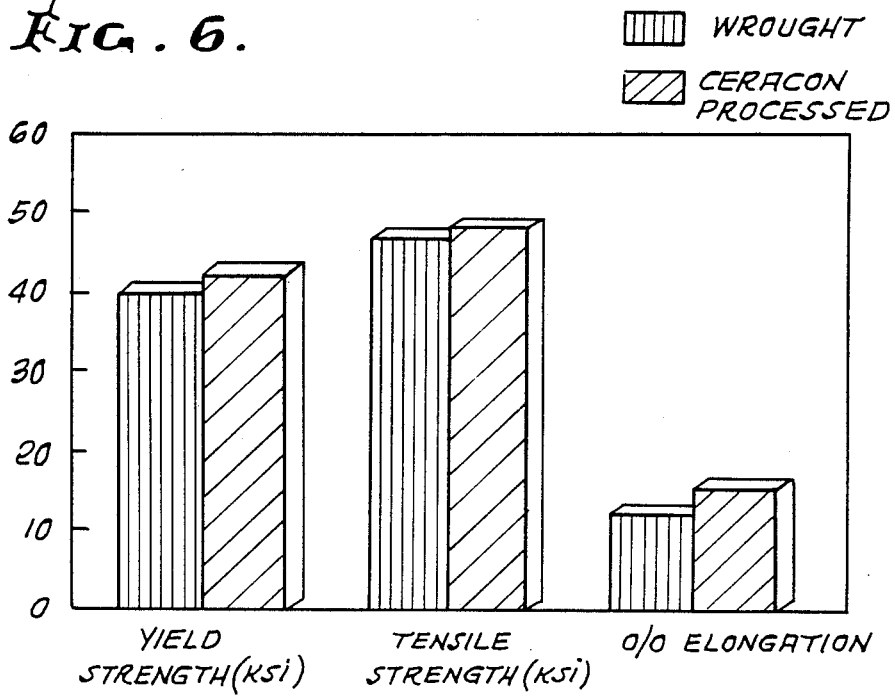
FIG. 6 is a bar chart comparing properties of 6061 aluminum sample, one being wrought and the other being consolidated from a pressed powder preform in resemblance with the present invention.
Figure 7:
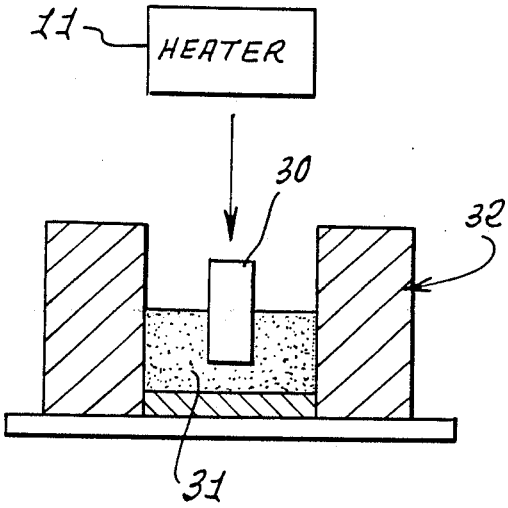
FIGS. 7–10 are elevations, taken in section, showing processing of a 2124 aluminum alloy preform.
Figure 8:
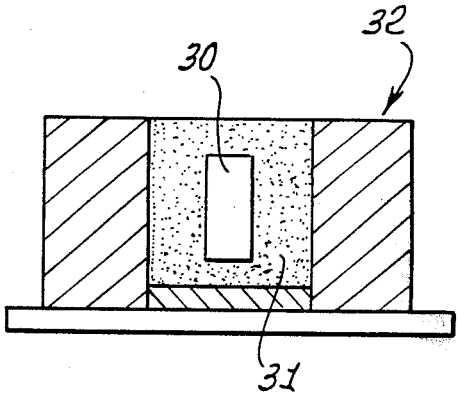

Comparison of results obtained from both wrought and consolidated 6061 has shown that the latter exhibits superior mechanical properties (FIG. 6). The most significant feature is approximately a 25% increase in elongation to failure in the P/M material. This finding is unexpected due to the anticipated embrittling effect of surface oxides that are present on the starting powders. The superior properties of the consolidated material can be related to the processing mechanism and the microstructural features revealed by both optical and scanning electron microscopy. The results from the optical evaluation of the consolidated 6061-T6 aluminum alloy specimens have shown that the oxide layers are well sheared and broken although the majority remains near the particle boundary. The mechanism of the process on P/M aluminum involves plastic deformation of the particles under high temperature and pressure. A small amount of liquid phase may exist during processing, since the consolidation is carried out at a temperature between the solidus and liquidus temperatures. However, the consolidation mechanism most likely does not involve liquid phase sintering, since a recrystallized liquid phase was not found near grain boundaries. In addition, liquid phase sintering of aluminum alloys usually leads to brittle behavior, with oxide particles distributed evenly throughout the grain boundary. For example, an elongation to failure of 3% was observed for a T6 aluminum alloy with composition similar to the 6061. The rapidly consolidated material exhibits a 15% elongation to failure without a loss in strength. The consistency of improved strength and ductility also suggests that liquid phase sintering is not the controlling mechanism. However, the controlling mechanism can be envisaged as severe plastic deformation of the aluminum particles leading to surface oxide breakup. Where the oxide layer was sheared, metal-metal as well as metal-oxide-metal diffusion bonding can take place and increase the bonding strength between the individual particles.

As a second example, helium gas atomized 2124 aluminum powder was initially cold pressed into 76 mm×13 mm×14 mm bars. Unlike the powder used in the above 6061 Al example, the starting powder for the 2124 aluminum consists of only two major particle fractions: −325 and −60/+230 mesh particles. The two powders were mixed in a V-blender in various proportions.

Figure 9:
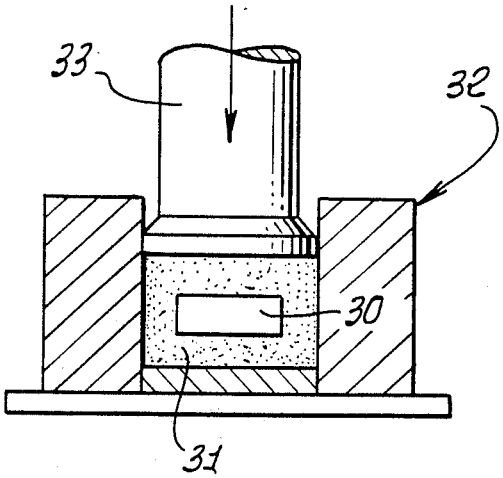
Figure 10:
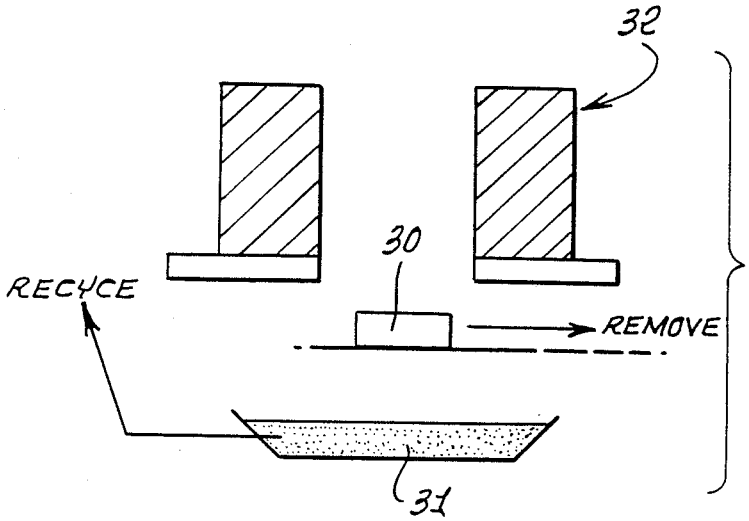

The process is depicted schematically in FIGS. 7–10. The green preform 30 was first preheated for 10 minutes total in an inert atmosphere ($N_2$) to three different temperatures, 773K (931° F.), 798K (976° F.), and 883K (1129° F.), (equal time intervals at each temperature) while the graphitic pressure transmitting medium (PTM) was heated to about 894K (1150° F.) in the PTM heater. After the preform reached the desired processing temperature, half of the necessary PTM 31 was poured into a pre-heated die 32. The preform 30 was placed immediately into the die (see FIG. 7), and the die was then filled completely with the remainder of the heated PTM (see FIG. 8). A pressure of 1.24 GPa (180 ksi) was applied by a ram 33 to consolidate (about 1 second) the preform as seen in FIG. 9. After releasing the pressure, the consolidated part was removed as in FIG. 10, and the hot PTM was recycled back into the PTM heater. The dimensions of the consolidated bar were approximately 83 mm×16 mm×9.6 mm, as in the first example, also.

As a third example, an atomized 7064 powder was similarly cold pressed into cylinders and consolidated to full density using temperatures ranging from 773K (931° F.) to 903K (1165° F ). The sample consolidation pressure was 1.24 GPa, but lower pressures can also achieve full density.

We claim:

1. The method of consolidating metal powders selected from the group consisting essentially of aluminum, aluminum alloys, and aluminum metal matrix composites that includes:

(a) pressing said powder into a preform, and preheating the preform to elevated temperature, (b) providing a bed of flowable pressure transmitting particles, (c) positioning the preform in such relation to the bed that the particles encompass the preform, (d) and pressurizing said bed to compress said particles and cause pressure transmission via the particles to the preform, thereby to consolidate the preform into a desired shape, (e) said metal powder having surface oxide, and said pressurizing being carried out to break up, partially or fully, said surface oxide, and to cause resultant formation of metal-metal as well as metal-oxide-metal bonds.

2. The method of claim 1 wherein the pressurization is caused out at temperature and pressure to cause plastic deformation of the preform metal powder.

3. The method of claim 1 wherein the metal powder is a mix of a varying or non-varying distribution of particles.

4. The method of claim 1 including preheating the pressure transmitting particles, which are carbonaceous.

5. The method of claim 4 wherein the pressure transmitting particles in the bed are preheated to elevated temperatures between 644K (700° F.) and 1033K (1400° F.).

6. The method of claim 1 wherein the preform is pre-heated to elevated temperatures between 594K (1100° F. ) and 933K (1219° F.).

7. The method of claim 1 wherein said pressurizing is carried out at between 0.68 and 1.30 GPa.

8. The method of claim 1 wherein the preheated preform is positioned in said bed, the particles of which are at elevated temperatures.

9. The method of claim 8 including providing a die into which the pre-heated particles are placed to form the bed.

10. The method of claim 9 wherein the preform is positioned in said bed to be surrounded by said particles in the die.

11. The method of claim 9 wherein the preform is positioned in said bed to be exposed at the top of the bed, and subsequently more of said preheated particles are placed into the die to cover the preform.

12. Articles produced by the method of claim 1.

* * * * *